United States Patent [19]

Caillet

[11] Patent Number: 4,850,294

[45] Date of Patent: Jul. 25, 1989

[54] HATCHWAY PANEL WITH IMPROVED SEALING DEVICE, PARTICULARLY USABLE FOR EQUIPPING CONTAINER CARRYING SHIPS

[76] Inventor: René Caillet, B.P. 19, F-78101, Saint Germain En Laye, France

[21] Appl. No.: 68,374

[22] Filed: Jul. 1, 1987

[30] Foreign Application Priority Data

Jul. 3, 1986 [FR] France ..... 86 09678

[51] Int. Cl.[4] ..... B63B 19/12

[52] U.S. Cl. ..... 114/201 R

[58] Field of Search ..... 114/72, 75, 201 R, 203, 114/259, 260; 914/138, 140

[56] References Cited

U.S. PATENT DOCUMENTS 3,552,345 1/1971 Harlander ..... 114/72

3,827,384 8/1974 Lunde et al. ..... 114/201 R

*Primary Examiner*—Joseph F. Peters, Jr.

*Assistant Examiner*—Jesus D. Sotelo

*Attorney, Agent, or Firm*—William A. Drucker

[57] ABSTRACT

A closure device is provided, particularly suitable for container carrying ships, including a plurality of independent hatchway panels, each panel having lengthwise and widthwise the dimensions of a container, each group of four vertical slides providing guiding and securing of the containers at their corners extending above the deck of the ship and the panel being applied sealingly and independently against the periphery of an opening surrounding said group of slides and against the internal face of the slide. In order to have access to a container stacked along the slides inside the hold, it is sufficient to remove the containers stacked above the panel, then this panel itself using the same handling device as for the containers.

15 Claims, 8 Drawing Sheets

Fig. 6
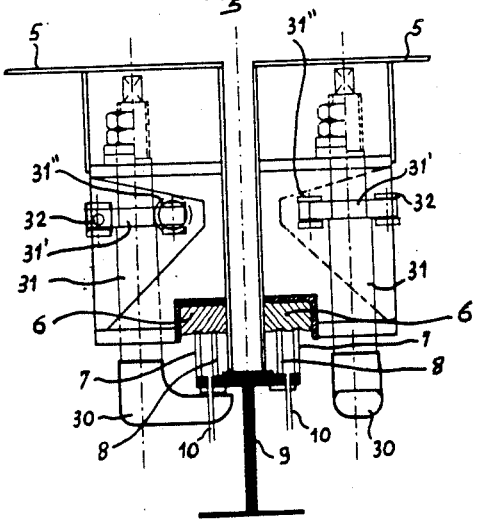
Fig. 7
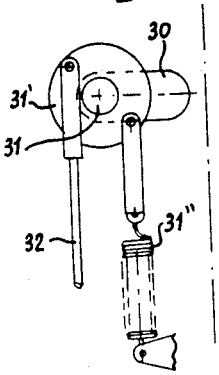
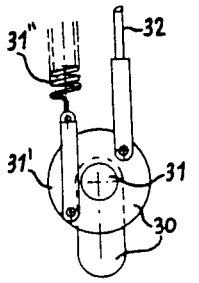
Fig. 8

HATCHWAY PANEL WITH IMPROVED SEALING DEVICE, PARTICULARLY USABLE FOR EQUIPPING CONTAINER CARRYING SHIPS

BACKGROUND OF THE INVENTION

1. Field of the Invention

The present invention relates to the transport of containers on board ships.

Container carrying ships generally use, for positioning and securing the containers in the hold, slides cooperating with the corners of each container. Above the hold, the containers are positioned on the sealed closure panels by means of manually placed bars, chains, tensioners etc. An improvement has been made there-to, for facilitating the positioning and stowage of the containers on the panels, which consists in extending the slides above the panels. These slides must then be interrupted, or have a removable part, so as to allow the panel to move in a horizontal plane during its opening movement so that, when it is desired to unload a container stored in a given hold, it is first of all necessary to remove all the containers placed in several piles on the closure panel of this hold, which represents considerable work and a considerable waste of time.

2. Description of the Prior Art

The U.S. Pat. No. 3,827,384 proposes using, on a container carrying ship having a storage space inside which are disposed container receiving cells each formed by a group of vertical slides extending above this storage space, using independent closure panels each designed so as to slide inside a group of slides. Each independent panel has at its opposite ends hinged parts which, in the closed position of the panel, come into the extension of this latter which then has a length greater than that of the cell formed by the slides. This arrangement has the drawback of requiring interruption of the vertical slides at the level of the deck, and of preventing storage of the panel in another available slide group.

SUMMARY OF THE INVENTION

The aim of the present invention is to overcome the disadvantages of known devices and for this purpose provides a simple device of great efficiency which not only allows the system to be used for guiding the containers by vertical slides projecting above the deck without requiring, so as to have access to a container stored in a hold, moving the containers other than those stored directly above it, but also does not require the slides to be interrupted at the level of the hatchway panels and which further allows these panels to be stored at any height of a group of other available slides.

In the invention, with each slide system for guiding a pile of containers there is associated an independent hatchway panel intended to cover the position of only a single container, and this panel cooperates sealingly with a fixed frame formed in the deck and with the inside of the guide slides without these latter being interrupted. The panel is advantageously designed so as to be operated by the handling spreader used for taking the containers and it will thus be readily understood that, for having access to a container stacked inside a hole of a ship, it is then sufficient to remove the containers stacked on the bridge above the container to which it is desired to have access, to remove the corresponding hatchway panel by sliding it along the slides by means of the spreader already used for the containers and possibly removing the stacked containers, inside the hold, above the one to be reached.

Sealing of the panel of the invention about its periphery is provided, under the effect of its own weight and conventional bolts, by the compression of a seal, whereas sealing inside each slide is provided by a seal which is pressed either horizontally inside the slide or vertically in a short trough formed therein. The sealer which cooperates with the slide is mounted for example on a pivoting flap which is held tight in the sealing position under the action of a spring.

At its four corners the panel of the invention includes openings which are identical to those of a container, thus allowing the panel to be handled by means of a conventional spreader. However, these openings are fixed on parts likely to slide vertically before coming into abutment in the raised position of the panel, sliding of these parts automatically controlling the withdrawal of the bolts of the panel and retraction of the seals and of the bolts inside the slides, which allows the panel to leave its slides. For repositioning the panel, the reverse operation is carried out by means of the spreader, release of the corner pieces of the panel by the spreader controlling the sealed locking of the panel through the action of springs or counterweights.

BRIEF DESCRIPTION OF THE DRAWINGS

For a good understanding of the device of the invention, a preferred embodiment thereof will be described hereafter by way of non limitative example, with reference to the accompanying drawings in which:

FIG. 6 is a vertical sectional view taken along line VI—VI of FIG. 2;

FIGS. 7 and 8 are partial plane views of the locking device of FIG. 6, respectively in an active position and in a rest position;

DESCRIPTION OF THE PREFERRED EMBODIMENTS

Figure 1:
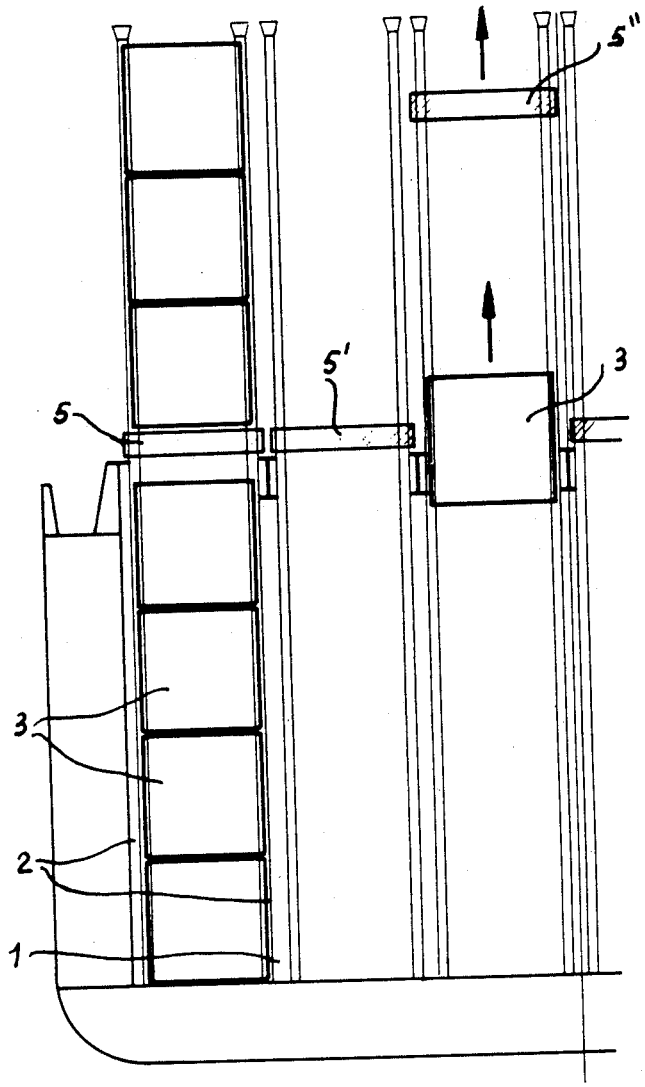
FIG. 1 is a partial diagrammatic view in vertical section of a container carrying ship showing closure of the hold thereof by means of the individual panels of the invention.
Figure 2:
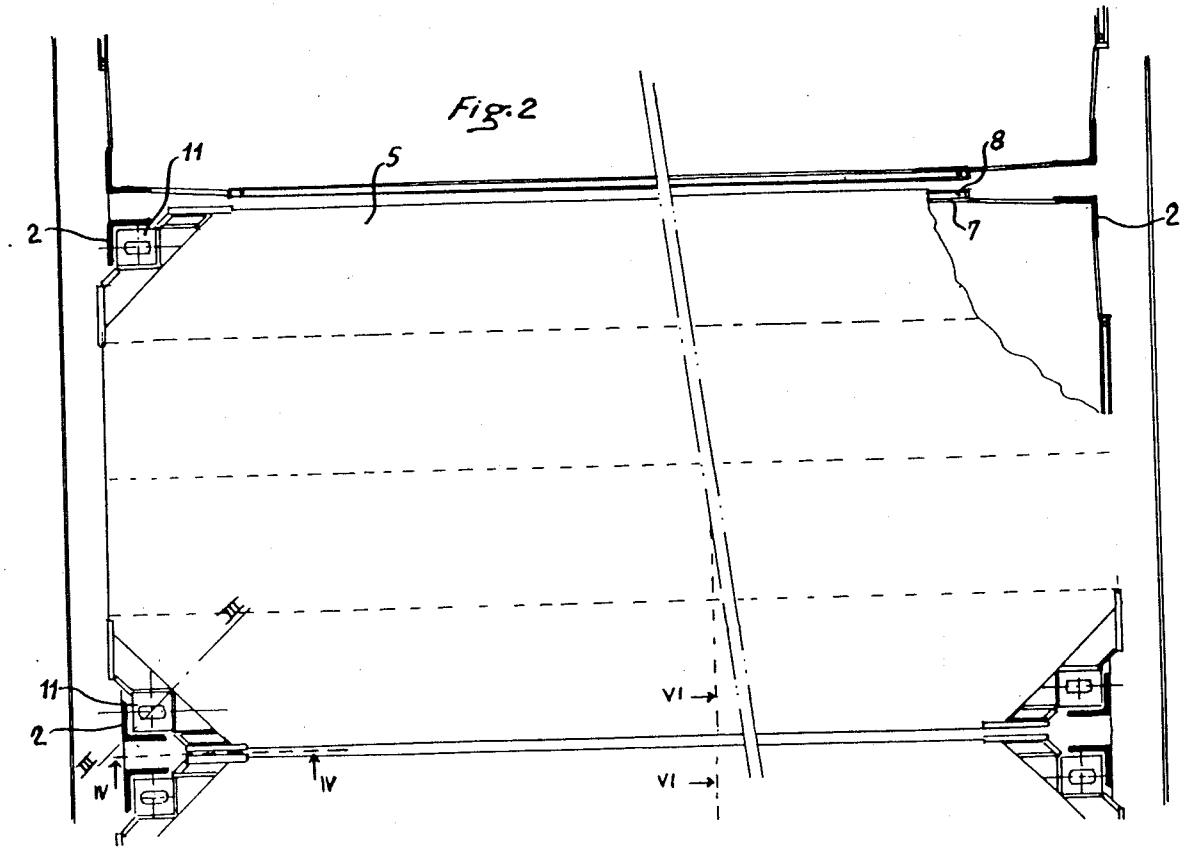
FIG. 2 is a top view with parts cut away of a panel of the invention, in the closed position, disposed between another closed panel and an unclosed hatchway.

Referring to FIG. 1, the hold of a container carrying ship has been shown at 1 and at 2 a plurality of vertical slides extending from the bottom of the hold and which continue above the deck of the ship. These slides 2, which each have the form of an angle iron, are disposed in groups of four so as to guide the four corners of a container 3. The closure of the hold is achieved in accordance with the invention by means of identical panels 5, independent of each other, which are each intended to be guided by a group of slides 2 and to provide sealed closure of the opening formed in the deck for the passage of these slides. In FIG. 1, the left hand part looking at this Figure shows, held by slides 2, a stack of containers 3 disposed both in hold 1 and above the panel 5 in the closed position. The central part of this Figure shows the same stack after the containers 3 disposed on panels 5' have been removed, and the right hand part shows removal of the panel 5" so as to allow access to a container 3 stacked inside the hold 1 and shown at the moment when it crosses the panel level.

Figure 9:
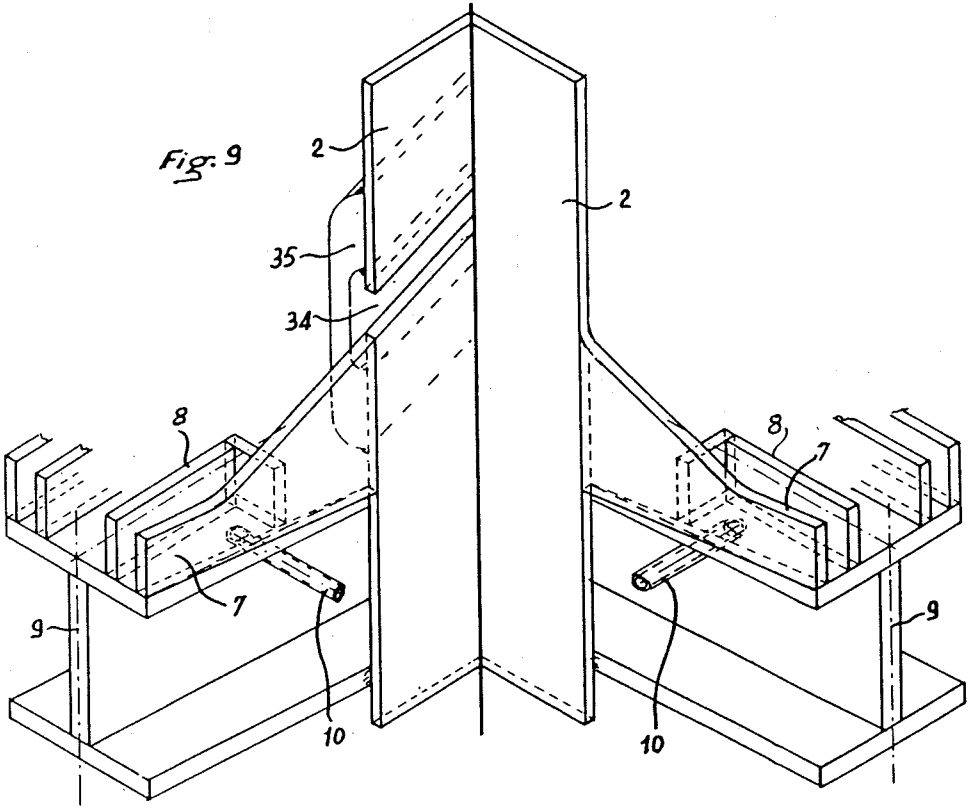
FIG. 9 is a perspective view showing the edge of the hatchway in the vicinity of a vertical slide, showing two different embodiments of the sealing device.

Panel 5, which in length and width has substantially the dimensions of a container, has on its' transverse and longitudinal edges a seal 6 (FIG. 6) made from rubber or any other suitable flexible and resilient material), intended to be compressed in a closed position between the parallel flanges 7, 8 of a beam 9 integral with the structure of the ship. For removing the leaks likely to occur between flanges 7, 8 at the four corners of the panel, from the space between these two flanges, drains 10 are provided which are directed outwardly (FIGS. 6 and 9).

Figure 3:
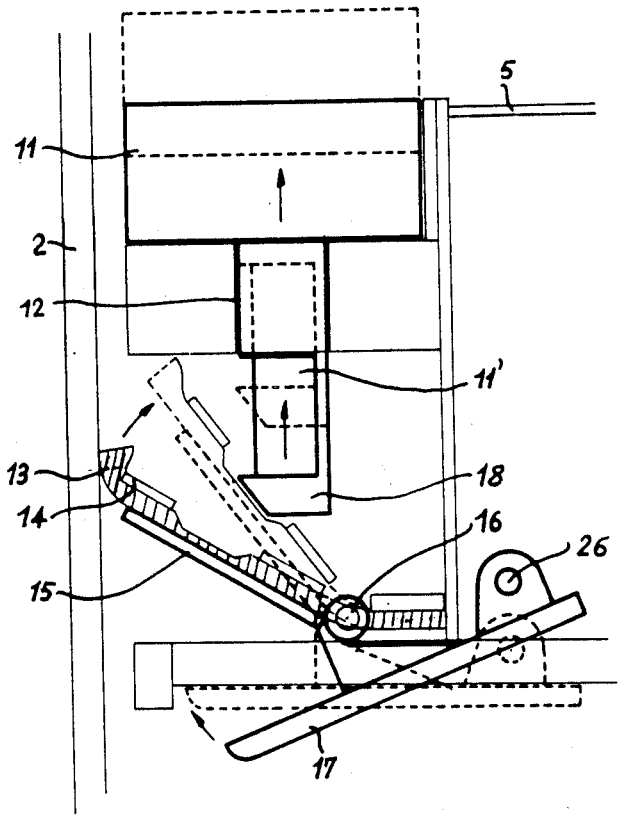
FIG. 3 is a vertical sectional view of a corner of a panel of FIG. 2, taken through the plane bisecting one of the guide slides, shown by the line III—III of FIG. 2.
Figure 4:
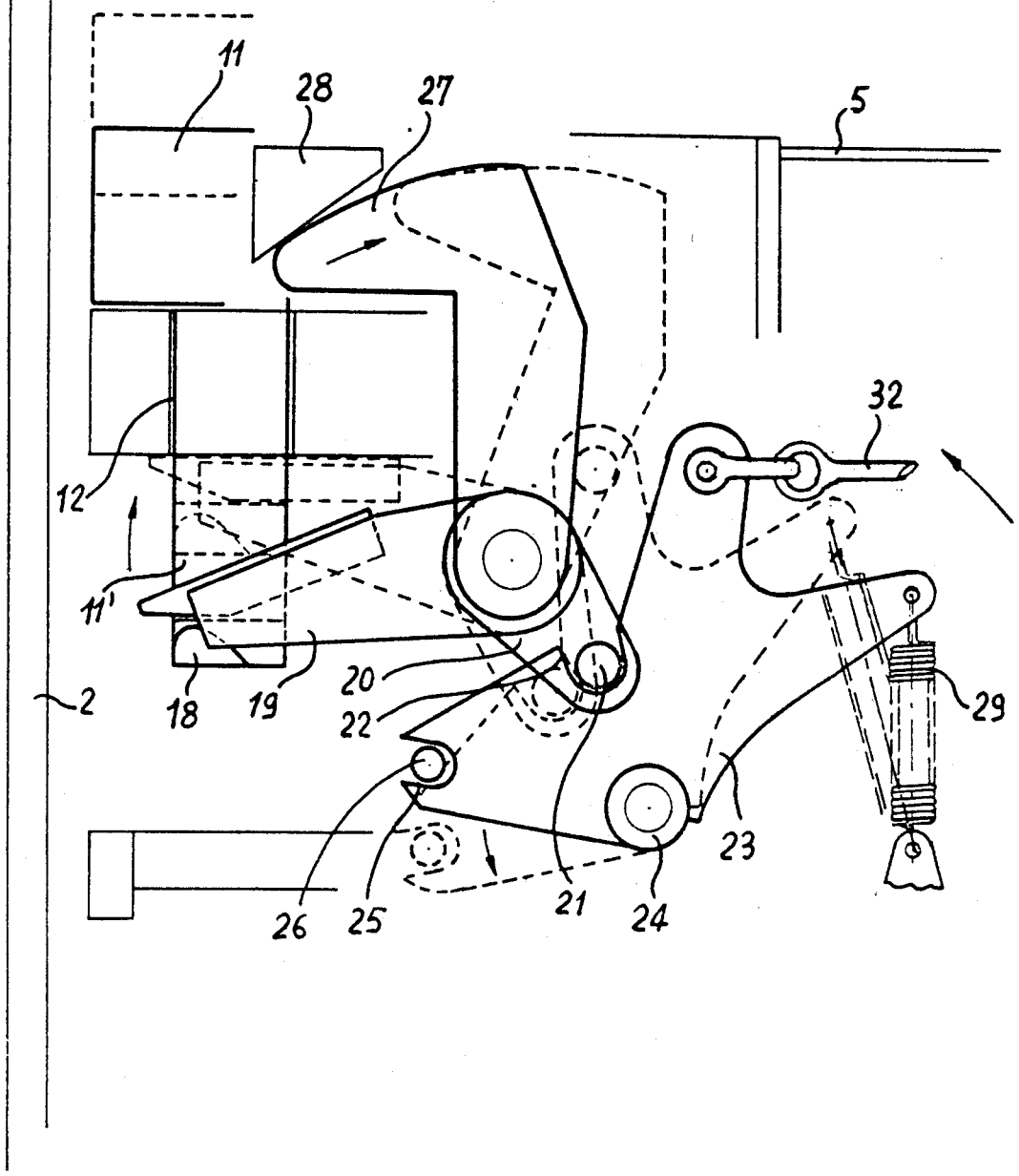
FIG. 4 is a vertical sectional view of a corner of the panel of the invention, taken along a line IV—IV of FIG. 2.
Figure 5:
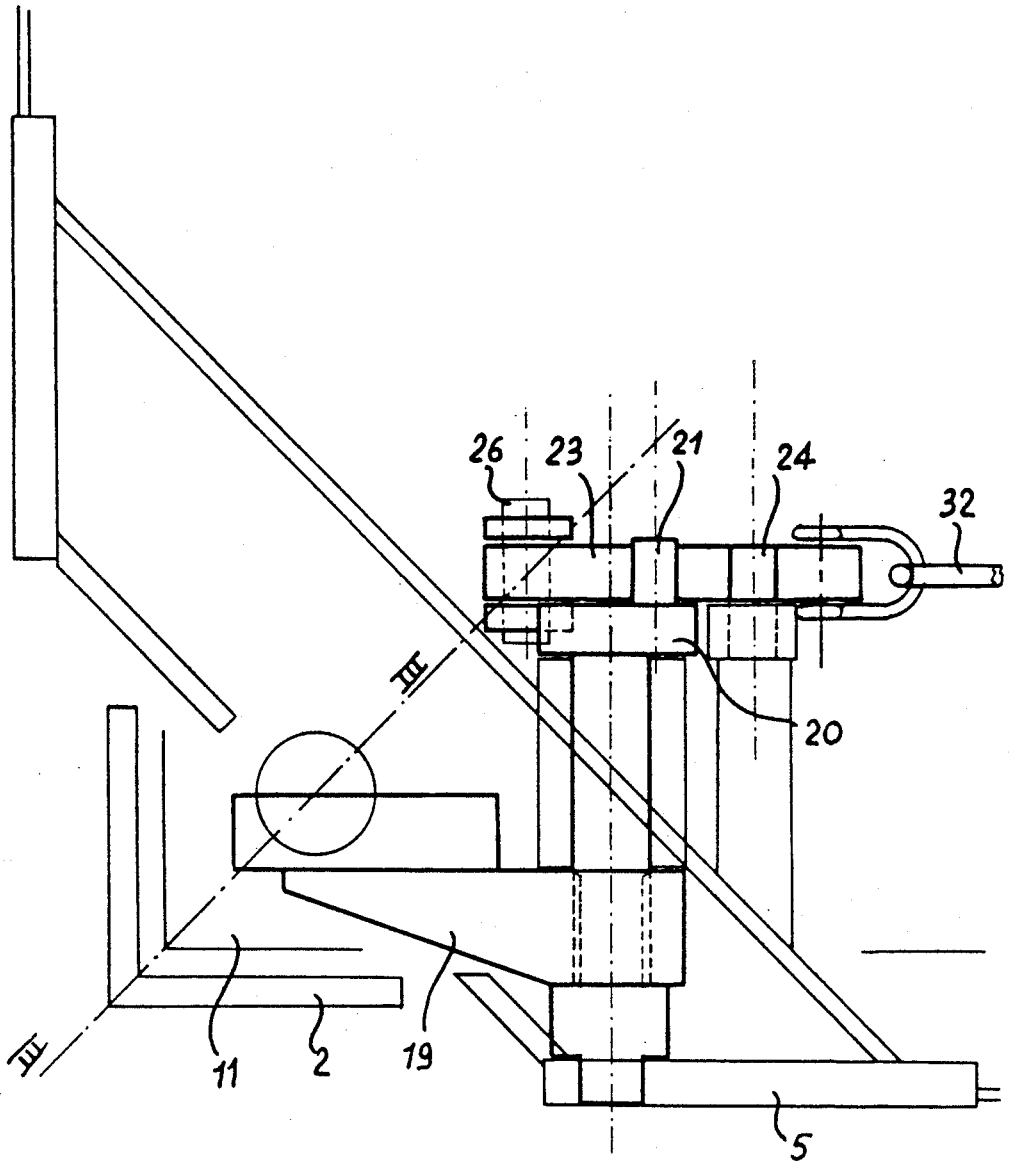
FIG. 5 is a partial plane view of one of the corners of the panel.

At each corner panel 5 has a gripping corner 11, similar to that of a standard container and designed so as to be engaged by a means for lifting the containers, for example a so called spreader. The gripping corner is mounted so as to slide vertically along a limited path in a cylindrical housing 12 formed in the panel, when the corner 11 is engaged by the spreader (FIGS. 3 and 4). The vertical movement of the corner could also be provided by a hinge.

Sealing at each of the four corners of panel 5, which is provided in contact with slides 2, is achieved by means of a corner seal 13 of triangular shape (see FIG. 3), obtained by joining up the adjacent ends of the longitudinal and transverse parts of seal 6. This corner seal 13 is fixed by means of a butt strap 14 on a pivoting flap 15 hinged along a shaft 16 carried by panel 5. Flap 15 may pivot in a vertical plane between a lowered position (shown with a continuous line in FIG. 3) in which the triangular seal 13 is applied horizontally against the inner faces of slide 2 while providing sealing therealong, and a raised position (shown with broken lines) in which seal 13 is freed from slide 2.

Flap 15 is integral with a shoe 17 which projects under panel 5 and whose orientation with respect to flap 15 is such that, in the raised position of this flap, shoe 17 comes into a horizontal position where it does not project from the panel (position shown with broken lines in FIG. 3).

The gripping corner 11 has at its lower end a hooked shaped part 18, which, in the raised position of corner 11 (shown with a broken line in FIG. 4) drives a lever 19 whose extension 20 carries a pin 21 which cooperates with a notch 22 formed in a piece 23 rotating about a fixed pin 24. Piece 23 has another notch 25 which acts on a pin 26, integral with the shoe 17, for controlling the movement of flap 15 between its lowered position and its raised position. On lever 19 is fixed a hook 27 which is designed, in the position of this lever 19 corresponding to the lowered position of corner 11, to engage an abutment piece 28 carried by slide 2 so as to provide locking of the panel. A powerful return spring 29 is disposed between the rotary piece 23 and panel 5.

When panel 5 is used for closing a hatchway provided for the passage of standardized containers of a length of 40 feet 12.192 meters), one or more bolts 30 are provided midway along each longitudinal side of the panel (FIG. 6). This bolt 30, which has a right angled shape, is carried by the lower end of a vertical rod 31 mounted for rotating in a housing in the panel. Rod 31 is fixed at its periphery to a ring shaped piece 31' on which are fixed, while being diametrically opposite, the end of a spring 31", returning bolt 30 to the bolted position, and an end of a link 32 itself connected to the rotary piece 23. Thus, pivoting of piece 23 in an anticlockwise direction looking at FIG. 4 drives rod 31 through a quarter of a revolution bringing bolt 30 into its unbolted position shown in the right hand part looking at FIG. 6, whereas rotation of piece 23 in the opposite direction, during release of corner 11, allows rod 31 to rotate through a quarter of a revolution in the other direction under the action of spring 31" so as to bring bolt 31 into the locked position shown in the left hand part looking at FIG. 6.

The operation is clear from the above description. When containers 3, guided by the same group of slides 2, have been stacked up to the top of the hold 1 of the ship, by means of a conventional handling device such as a spreader, the corresponding hatchway is then closed by means of a panel 5 which is gripped at the position of its corners by the spreader and is lowered along slides 2. During this movement, the tractive force which is exerted on corners 11 brings the locking hooks 27 into their retracted position shown with broken lines in FIG. 4 and, through the rotary piece 23, flap 15 is brought into its raised position shown with broken lines in FIG. 3. If it is a panel having an intermediate bolt 30, this is in its released position shown in the right hand part of FIG. 6. At the end of its downward movement panel 5 engages the periphery of the hatchway, the spreader releasing the corners 11 which move down by inertia into their housings 12. This movement of corners 11 releases the assembly formed by lever 19 and the rotary piece 23 which, under the action of spring 29, come into the position shown with a continuous line in FIG. 4, in which position hooks 27 (and possibly the bolt 30 of FIG. 6 by the action of springs 32") come into the locked position of the panel. This position at piece 23, through the pin 26 of the shoe 17, causes flap 16 to come into the lowered position in which the triangular seal 13 is applied against the inner corner of slide 2 (position shown with a continuous line in FIG. 3). Thus, without any manual intervention, the panel 5 is automatically positioned and sealingly locked not only along the longitudinal and lateral edges of the hatchway through seal 6) but also against the internal face of the guide slides 2 (by means of the triangle of seals 13). Stacking of containers above panel 5 may then be continued, along the same slides 2.

If it is desired to have access to one of the containers 3 stacked in hold 1 between said slides 2, the containers 3 stacked above the hatchway panel 5 are then removed by means of a spreader then with the same device panel 5 is gripped by its corners 11. The tractive force thus exerted on corners 11 causes these latter to slide into their top position while automatically unlocking the panel (bolts 27 and 30) and releasing the triangular seals 13 from the angle irons 2. The panel may thus be raised along slides 2 so as to be laid on another panel, on a container or on the ground of the quay. In this position, panel 5 then rests on shoes 17 which come into the horizontal position shown with a broken line in FIG. 3, to which corresponds the raised position of flap 15, thus, although the corners 11 are released, the triangular seals 13 as well as bolts 27 and 30 are then in their retracted position in which they do not project beyond the geometry of the panel and therefore do not risk being damaged by a moving object in the vicinity. Nevertheless, corner 11 moves down again by inertia into the low position, by means of an aperture 11' formed in the body of this corner above the part 18, while thus being protected and being able to receive other panels or containers stacked thereon.

Figure 10:
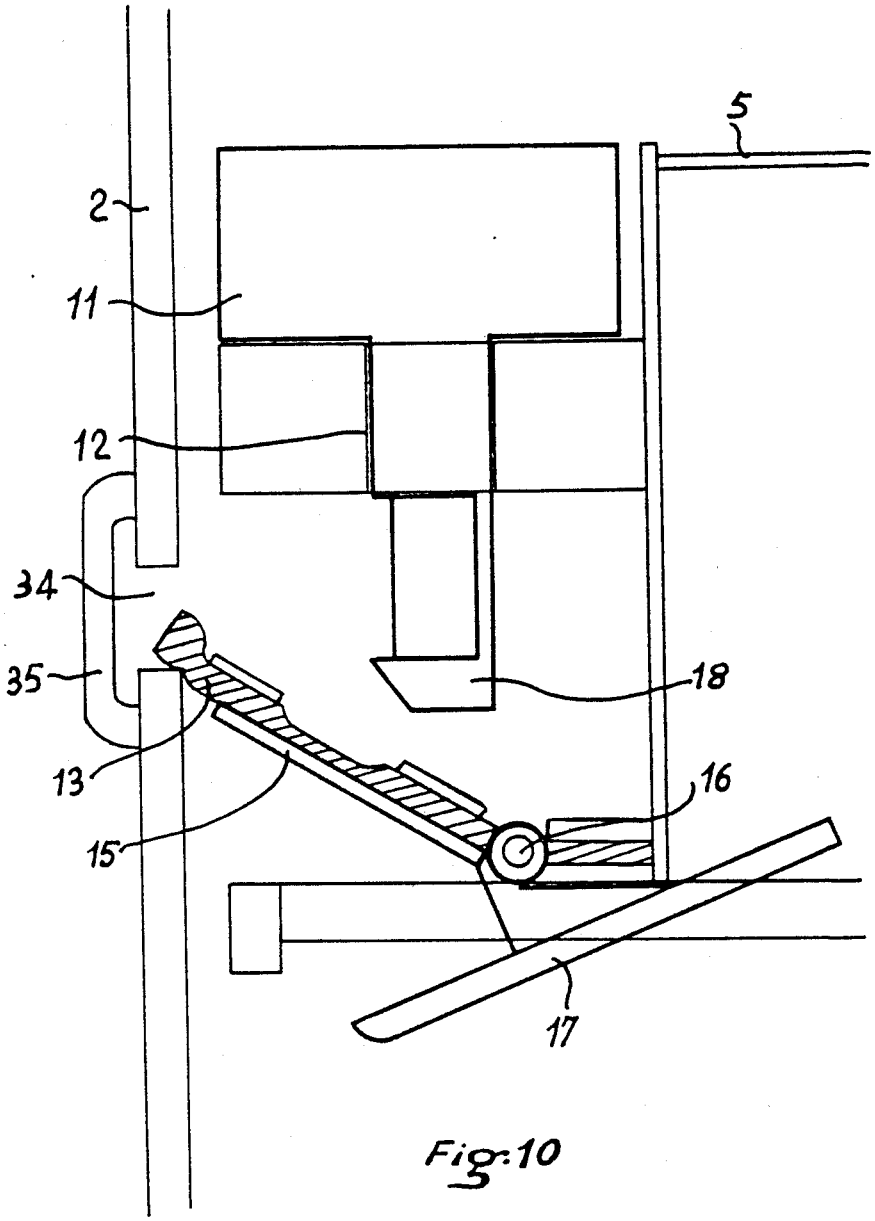
FIG. 10 is a variation of FIG. 3 showing the cooperation of a corner seal with a groove in the vertical slide.

In a variant shown in FIG. 10, the triangular seal 13 carried by the pivoting flap 15 is designed, in its active position corresponding to the released condition of the corners 11 of the panel, to engage in a practically horizontal trough 34 formed in each of the two wings of slide 2, thus providing vertical sealing. In this case, slide 2 is equipped at the level of trough 34 with an external reinforcement 35. Since this trough 34 is slanted, it does not interrupt sliding of the containers. In FIG. 9, the right hand slide part has been shown continuous, for a horizontal application of seal 13, whereas the lefthand part of the slide has been shown with trough 34 so as to allow vertical application of seal 13.

It will be readily understood that the above description has ben given by way of simple example, without any limitative character, and that constructional additions or modifications could be made thereto without departing from the scope and spirit of the invention defined by the following claims. It will be understood in particular that in place of springs 20 and 31'' other return means could be used such as counterweights or compressed fluid. It will also be understood that the application of seal 13 against this side could be obtained either by a movement of flap 15 other than pivoting, or by means of a fluid following the known principle of the inflatable seal, release of seal 13 always taking place through the movement of corner 11.

What is claimed is:

1. In a device for sealingly closing a container storage space with a plurality of groups of vertical slides, each of said groups including four slides intended to cooperate with the corners of containers to be stacked and which extend above said storage space so as to allow stacking of the containers on a closure device in the closed position, said closure device being formed by a plurality of individual panels designed to be applied independently, by sliding each along one of said groups of vertical slides, sealingly on the periphery of an opening surrounding said group of vertical slides, each said panel, in the open position as in the closed position, has in the vicinity of the slides the lengthwise and widthwise dimensions of a container and includes at each corner sealing means adapted for cooperating sealingly with the internal part of the vertical slide corresponding to this corner, which allows uninterrupted slides to be used.

2. A hatchway panel for constructing the closure device as claimed in claim 1, having, along its longitudinal and transverse edges, seals intended to be compressed vertically against the periphery of the opening to be closed and, at each corner, a seal having, in section, a triangular shape for sealingly cooperating with the internal part of a vertical slide corresponding to this corner.

3. The panel as claimed in claim 2, wherein said corner seal is mounted on a flap which is movable, for example by pivoting, between a raised release position and a lowered position in sealing contact with the slide.

4. The panel as claimed in claim 3, having at each corner a vertically movable piece allowing it to be gripped by a container handling device, a mechanical connection being provided between said piece and said flap associated with the same corner of the panel for automatically causing the flap to come into its raised position releasing the corner seal when a tractive force is applied to said piece, a return spring bringing the flap back to the lowered position in contact with the corner seal when said piece is released.

5. The panel as claimed in claim 4, wherein means for locking the panel in the closed position are provided at each corner thereof, said locking means being connected by a mechanism to the vertically movable piece associated with the same corner of the panel for automatically controlling unlocking of the panel when a tractive force is applied to said vertically movable pieces, a return means bringing said locking means back into the active position when said vertically movable pieces are released.

6. The panel as claimed in claim 5, having, midway along its length, on each longitudinal side thereof, a locking member whose passage into the unlocked or locked positions, depending on whether the vertically movable pieces receive a tractive force or are released, is controlled automatically by said mechanism and by said return means.

7. The panel as claimed in claim 4, including at each corner a pivoting shoe secured to said flap and projecting under the panel through an opening therein, the shoe and the flap presenting a relative slant being such that, when the panel is laid on the ground, the bottom of the ship or a container in its slides, the flap and the locking means are then in a raised and protected position allowing the panel to be stored at any height in an available group of the slides, wherein the vertically movable piece is nevertheless free to move down to its low position so that, without danger for the mechanical parts, it may receive any load of other panels or containers being stored.

8. The panel as claimed in claim 7, wherein each vertically movable piece has a lower part which cooperates with a pivoting lever fixed to a hook for locking the panel designed for engagement under a fixed abutment member, said pivoting lever engaging a piece rotating about a fixed pin against the action of said return means, and said rotating piece cooperating on the one hand, with a pin integral with the flap and, on the other hand, with a control link of an intermediate locking member.

9. The panel as claimed in claim 5, including at each corner of a pivoting shoe secured to said flap and projecting under the panel through an opening therein, the shoe and the flap presenting a relative slant being such that, when the panel is laid on the ground, the bottom of the ship or container in its slides, the flap and locking means are then in a raised and protected position allowing the panel to be stored at any height in an available group of slides, wherein the vertically movable piece is nevertheless free to move down to its low position so that, without danger to mechanical parts thereof, it may receive any load of other panels or containers being stored.

10. The panel as claimed in claim 9, wherein each vertically movable piece has a lower part which cooperates with a pivoting lever fixed to a hook for locking the panel designed for engagement under a fixed abutment member, said pivoting lever engaging a piece rotating about a fixed pin against the action of said return means, and said rotating piece cooperating on the one hand, with a pin integral with the flap and, on the other hand, with a control link of an intermediate locking member.

11. The panel as claimed in claim 5, wherein each vertically movable piece has a lower part which cooperates with a pivoting lever fixed to a hook for locking the panel designed for engagement under a fixed abutment member, said pivoting lever engaging a piece rotating about a fixed pin against the action of return means, and said rotating piece cooperating on the one hand, with a pin integral with the flap and, on the other hand, with a control link of an intermediate locking member.

12. The panel as claimed in claim 3, wherein the sealing contact of the corner seal is provided horizontally against the internal face of two adjacent wings of the slide.

13. The panel as claimed in claim 3, wherein the sealing contact of the corner seal is provided vertically in a trough formed in two adjacent wings of the slide.

14. The panel as claimed in claim 2, wherein the sealing contact of the corner seal is provided horizontally against the internal face of two adjacent wings of the slide.

15. The panel as claimed in claim 2, wherein the sealing contact of the corner seal is provided vertically in a trough formed in two adjacent wings of the slide.

* * * * *